United States Patent [19]

McDonough et al.

[11] 4,134,201

[45] Jan. 16, 1979

[54] CRIMP DIE WITH RESILIENT ANVIL

[75] Inventors: Cletus McDonough, Elmhurst; Leonard A. Sowinski, Chicago, both of Ill.

[73] Assignee: Molex Incorporated, Lisle, Ill.

[21] Appl. No.: 797,986

[22] Filed: May 18, 1977

[51] Int. Cl.[2] ..... H01R 43/04

[52] U.S. Cl. ..... 29/753; 29/566.2; 72/465

[58] Field of Search ..... 29/753, 751, 566.2; 72/465

[56] References Cited

U.S. PATENT DOCUMENTS

| | | | |
|---|---|---|---|
| 3,258,948 | 7/1966 | Carlson, Sr. | 72/465 X |
| 4,025,999 | 5/1977 | Wolyn et al. | 29/753 |

*Primary Examiner*—Carl E. Hall

*Attorney, Agent, or Firm*—Louis A. Hecht

[57] ABSTRACT

A die for crimping an electrical terminal onto a wire lead. This includes a base with a terminal support structure for supporting and feeding a strip of terminals to a crimp station overlying an anvil. Punch means are provided over the anvil adapted to move in contact with a terminal at the crimp station to form with the anvil an electrical connection between the wire lead and terminal. The anvil is supported on a resilient cantilever beam member which deflects during the crimping operation.

6 Claims, 5 Drawing Figures

FIG. 1
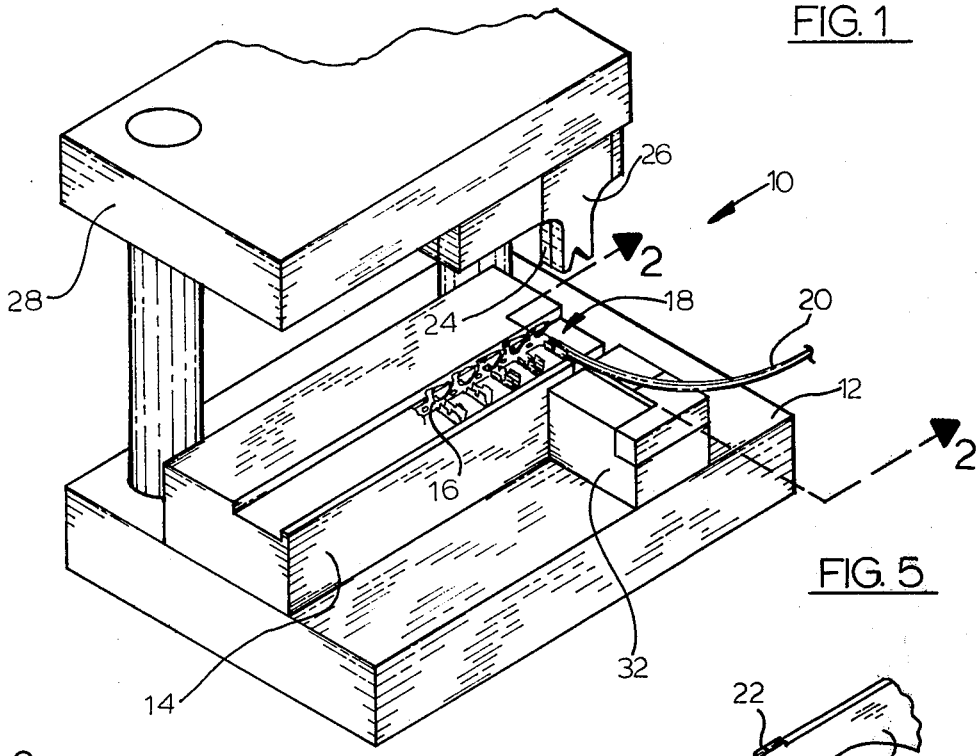
FIG. 5
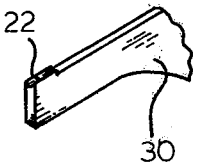
FIG. 2
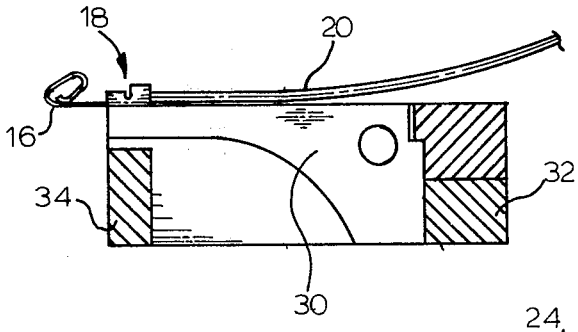
FIG. 3
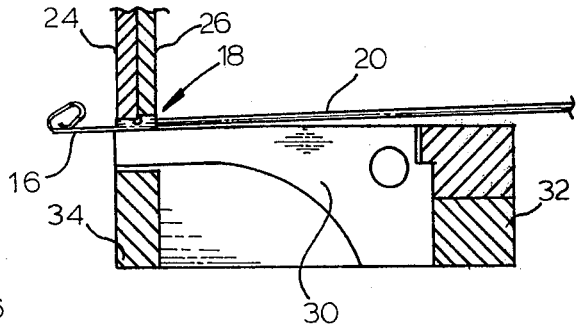
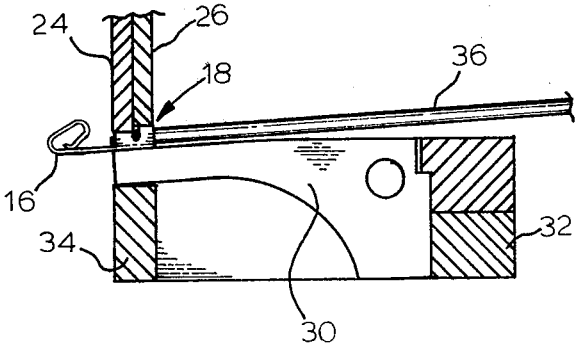
FIG. 4

CRIMP DIE WITH RESILIENT ANVIL

BACKGROUND OF THE INVENTION

1. Field of the Invention

The present invention relates to a die for crimping an electrical terminal onto a wire lead.

2. A Brief Description of the Prior Art

Crimping machines are well known in the electrical components industry for the purpose of crimping or forming an electrical metal terminal onto a stripped insulated wire lead. Machines of this type generally comprise a crimping die which is adapted to crimp a given styled terminal and a punch press associated with the die for actuating the die.

Conventional crimping dies include a die shoe with a terminal support structure for supporting and feeding a strip of terminals to a crimp station which overlies the anvil. Punch means are mounted over the anvil and is adapted to move into contact with the terminal at the crimp station to form with the anvil an electrical connection between the wire lead and terminal.

In the past, if it was desired to use a different gauged wire, it was necessary to make an adjustment on the die so that the larger or smaller wire can be accommodated during the crimping operation. This adjustment might have to be made for either the conductor crimp or the insulation crimp. The manual adjustment might have been inaccurate or, at the very least, relatively time consuming to make.

In addition, various differences caused by tolerances in the wire may result in an imperfect crimp owing to the fact that the punch and anvil of the die are effective only over a relatively small range of tolerances.

SUMMARY OF THE INVENTION

It is, therefore, the principal object of the present invention to provide a new and improved crimping die of the type described which is operatable over a wider range of tolerances and which can accommodate a wider range of wire gauges without manual adjustment.

This object is accomplished by one embodiment of the invention which improves the anvil structure. The improvement generally comprises means for resiliently supporting the anvil so that the anvil will deflect in the direction of movement of the punch means.

BRIEF DESCRIPTION OF THE DRAWINGS

FIG. 1 is a fragmentary perspective view of the crimping die of the present invention;

FIG. 2 is a side sectional view taken generally along the line 2—2 of FIG. 1 prior to the crimping operation;

FIG. 3 is a side sectional view as that of FIG. 2 wherein the die is shown during the crimping operation;

FIG. 4 is a side sectional view the same as FIG. 3 showing the die crimping a larger gauged wire; and FIG. 5 is a fragmentary perspective view of the cantilever beam member of the die of the present invention.

DESCRIPTION OF THE PREFERRED EMBODIMENT

Turning now to FIG. 1, the crimping die, generally designated 10, of the present invention as illustrated. The die 10 is seen to generally include a die shoe 12 having a terminal support structure 14 thereon which is capable of supporting and feeding a strip of metal electrical terminals 16. The terminals 16 are fed one at a time, to a crimp station, generally designated 18, whereat it is crimped about a wire lead 20. During the crimping operation the terminal 16 is supported at the crimp station 18 over an anvil 22 as best seen in FIG. 5.

A conductor punch 24 and an insulation punch 26 overlie the crimp station 18 and are mounted on a punch holder 28. The punch holder 28 is movable downwardly in response to a punch press (not shown).

Unlike conventional crimp dies, the die 10 of the present invention includes means for resiliently supporting the anvil 22 so that it will deflect in the direction of movement of the punches 24 and 26. The means for resiliently supporting the anvil is a cantilever beam member 30 mounted on the die shoe 12 with the anvil 22 formed on the free end thereof. The beam member material 30 is made of high impact resistant material such as S7 steel.

The beam member 30 is mounted in a suitable enclosure 32 (FIG. 1). A stop member 34 is mounted below the free end of the beam member 30 to prevent excessive deflection of the beam member. The end opposite the free end is anchored against the enclosure 32.

Looking at FIGS. 2 and 3, a terminal 16 is shown at the crimp station over the anvil 22 just prior to the crimping operation. A wire lead 20 is laid in the terminal 16. FIG. 3 shows the punches 24 and 26 engaging the terminal 16 to form the crimp. It should be noted that the free end of the cantilever beam member 30 deflects somewhat in the direction of movement of the punches 24 and 26.

If a larger gauge wire 36 is desired to be crimped, no adjustment need be made. Instead, as is best seen in FIG. 4, the larger diameter of the wire results in the free end of the cantilever beam member 30 deflecting more than the thinner gauged wire shown in FIG. 3. This has a self-adjusting effect which insures a proper crimp without any manual adjustment.

The present invention offers unique advantages when gang crimping a plurality of wires. That is, if it is desired to simultaneously crimp the wires comprising a ribbon cable, there is the problem of variations in wire and insulation thickness among adjacent wires. In addition, the distance between adjacent wires is sufficiently close to amplify these problems. However, employing the resiliently supported anvil of the present invention, it becomes practical to gang crimp without requiring stringent ribbon cable manufacturing tolerances.

We claim:

1. In a die for crimping an electrical terminal onto a wire lead, including a base with a terminal support structure for supporting and feeding a strip of terminals to a crimp station having an anvil thereat, and punch means over said anvil for moving into contact with a terminal at the crimp station and forming with said anvil an electrical connection between the wire lead and terminal, the improvement comprising:

a cantilever beam member made of high-impact resistant material mounted on said base having the anvil formed on the free end thereof and having a thickness which will provide deflection in the direction of movement of said punch means.

2. The die of claim 1 wherein said high impact resistant material includes S7 steel.

3. The die of claim 1 including deflection stop means mounted below the free end of the beam member to prevent excessive deflection of said beam member.

4. A die for simultaneously crimping a plurality of electrical terminals onto a like number of wire leads comprising:

a base with a terminal support structure for supporting and feeding a strip of terminals to a crimp station with a plurality of anvils thereat;

a plurality of cantilever beam members mounted on said base, each having an anvil formed at the free end thereof, each beam member having a certain dimension and being made of materials of certain qualities to cause deflection upon impact against the anvil; and punch means over said anvils for moving into contact with said terminals at crimp station and forming with said anvils a plurality of electrical connections between the wire leads and the respective terminals.

5. The die of claim 4 wherein each beam member is made of high impact resistant material such as S7 steel.

6. The die of claim 4 including deflection stop means mounted below the free end of each beam member to prevent excessive deflection of each beam member.

* * * * *